US007774928B2

(12) United States Patent
Toeniskoetter

(10) Patent No.: US 7,774,928 B2
(45) Date of Patent: Aug. 17, 2010

(54) ROBOTIC PALLET DRIVE ARRANGEMENT IN A ROBOTIC ROLLER HEMMING SYSTEM

(75) Inventor: James B. Toeniskoetter, Rochester Hills, MI (US)

(73) Assignee: Hirotec America, Inc., Auburn Hills, MI (US)

( * ) Notice: Subject to any disclaimer, the term of this patent is extended or adjusted under 35 U.S.C. 154(b) by 1079 days.

(21) Appl. No.: 11/010,583

(22) Filed: Dec. 13, 2004

(65) Prior Publication Data

US 2006/0123615 A1 Jun. 15, 2006

(51) Int. Cl.
*B23P 21/00* (2006.01)

(52) U.S. Cl. ..... 29/784

(58) Field of Classification Search ..... 29/429, 29/564, 784, 791, 799, 822, 240, 281.1, 283; 901/7

See application file for complete search history.

(56) References Cited

U.S. PATENT DOCUMENTS 4,359,815 A * 11/1982 Toyoda ..... 483/14
5,709,303 A * 1/1998 Best ..... 206/459.1

* cited by examiner

*Primary Examiner*—John C Hong
(74) *Attorney, Agent, or Firm*—Fildes & Outland, P.C.

(57) ABSTRACT

A robotic pallet drive arrangement in a robotic roller hemming system including a track and a plurality of pallets movable on the track. The arrangement also includes a robot having an arm adapted for engagement with the pallets. Movement of the robot arm while the robot arm is engaged with one of the pallets moves the pallet along the track.

13 Claims, 10 Drawing Sheets

ROBOTIC PALLET DRIVE ARRANGEMENT IN A ROBOTIC ROLLER HEMMING SYSTEM

TECHNICAL FIELD

This invention relates to robotic roller hemming, and more particularly to fixture positioning in a robotic roller hemming system.

BACKGROUND OF THE INVENTION

It is known in the art relating to robotic roller hemming to utilize a motorized indexing drive system to index multiple anvil fixtures onto a turntable. The turntable is positioned in front of a hemming robot within the working range of the robot. The turntable may clamp the anvil fixtures in position on a turntable top plate, and operation of the motorized drive varies which anvil fixture is positioned on the turntable. The robot may then hem a workpiece on the anvil fixture that is within the working range of the robot. This arrangement allows for hemming of multiple closures in a single robotic roller hemming cell. The use of a motorized indexing drive system, however, increases the cost of this roller hemming arrangement.

SUMMARY OF THE INVENTION

The present invention provides a robotic pallet drive arrangement in a robotic roller hemming system which utilizes a hemming robot to position hemming tooling. The robotic pallet drive allows for the utilization of multiple anvils in a single robot roller hemming system without the significant additional cost of an indexing drive system for indexing anvil fixtures into position on a turntable. The present invention may be especially useful in low volume hemming cells or in higher speed cells that are run in batch mode where change-out time is not critical.

More particularly, a robotic pallet drive arrangement in a robotic roller hemming system in accordance with the present invention includes a track and pallet system disposed in an arcuate configuration around the base of the hemming robot. The pallets are supported on the track by, for example, rails of the track, and the pallets are movable along the track. The robot base includes the robot's first axis of rotation, which is centered on the center of the arc configuration of the track. In other words, the robot's first axis of rotation is centered on the pivot point of the radius of curvature of the track. The robot includes a movable arm adapted to engage the pallets. The robot may engage one of the pallets on the track and, by turning about its base, move the pallet to a new location on the track. The track may also include at least one locking device for locking the pallets at desired locations on the track until such time that it is necessary to move the pallets.

In a specific embodiment, a robotic pallet drive arrangement includes a robot having a base and a swingable, movable arm. The robot has a first axis of rotation extending through the base. A track is spacedly disposed from the robot. The track is configured in a generally arc shape. A plurality of pallets are freely movable on the track. The robot arm is operably engagable with each of the pallets. The track includes at least one locking device for releasably locking the pallets to the track, thereby temporarily immobilizing the pallets. Rotating the robot about the first axis while the robot arm is engaged with one of the pallets moves that pallet along the track.

The robot may include a working arm in addition to the arm that is operably engagable with the moveable pallets. Alternatively, the arm that is operably engagable with the pallets may be the working arm of the robot.

Each point along the arc of the track may be generally equidistant from the first axis of the robot. The track may have a plurality of stops disposed along the track defining storage positions, and the locking device may be adapted to lock the pallets at the storage positions. The track may be circular in shape. The robotic pallet drive may also include a turntable positioned in front of the robot at a working position along the track.

A method of driving a pallet along a track for a robotic roller hemmer system includes the step of providing a robotic pallet drive as described above. The method may further include the steps of: unlocking the locking devices to allow the pallets to be freely moved about the track; engaging the robot arm with one of the pallets; swinging the robot arm about the robot first axis, thereby moving the pallet along the track; stopping the movement of the robot arm, thereby stopping the pallet at a new position along the track; and locking the locking device to lock said pallets to said track. The step of moving the pallet along the track may include moving the pallet between a working position along the track and a storage position along the track. The step of moving the pallet along the track may alternatively include moving the pallet from one storage position along the track to another storage position along the track.

These and other features and advantages of the invention will be more fully understood from the following detailed description of the invention taken together with the accompanying drawings.

DETAILED DESCRIPTION OF THE INVENTION

Figure 1:
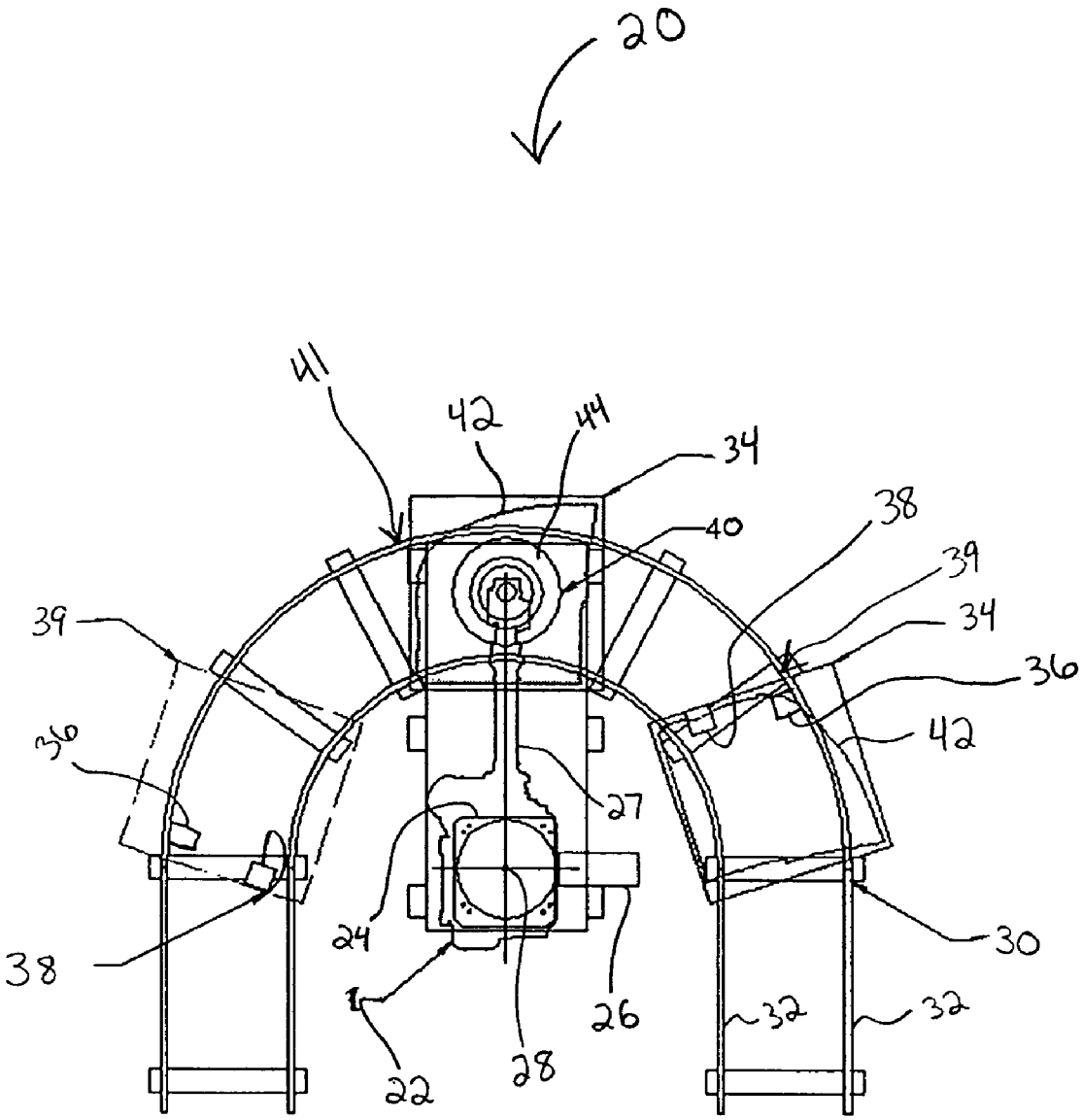
FIG. 1 is a schematic plan view of a robotic pallet drive arrangement in accordance with the present invention illustrating a working arm of a hemming robot in a working position.

Referring now to the drawings in detail, numeral 20 generally indicates a robotic pallet drive arrangement in a robotic roller hemming system in accordance with the present invention. The robotic pallet drive allows a hemming robot to move a plurality of anvil fixtures in a single robot roller hemming system without the significant additional cost of an indexing drive system for indexing anvil fixtures into position on a turntable.

As shown in FIGS. 1 through 6, in a first embodiment of the present invention the robotic pallet drive arrangement 20 includes a robot 22 including a base 24 and a swingable, movable arm 26. The robot 22 has a first axis of rotation 28 extending through the base 24. A track 30 is spacedly disposed from the robot 22. The track 30 is generally arcuate in shape and may include guides 32 such as rails or similar. In this embodiment, the track 30 forms a semi-circle, although it should be understood that the track may form any arcuate shape. A plurality of free-moving pallets 34 are supported by and movable on the track 30. The robot arm 26 is operably engagable with each of the pallets 34. In this embodiment, the robot 22 includes a working arm 27 in addition to the arm 26 that is operably engagable with the pallets 34. The working arm 27 is the arm of the robot 22 that working tasks such as hemming operations. The robot arm 26 is an auxiliary arm positioned at generally a 90 degree angle from the working arm 27 of the robot. The arm 26, however, may be positioned at an offset of any suitable angle from the working arm 27. The track 30 may include at least one locking device 36 for releasably locking the pallets 34 to the track 30. Rotating the robot 22 about the first axis 28 while the robot arm 26 is engaged with one of the pallets 34 moves the engaged pallet 34 along the track 30.

The track 30 may have a plurality of stops 38 disposed along the track defining storage positions 39, and the locking devices 36 may be adapted to lock the pallets 34 at the storage positions. The stops 38 index the track 30. The robotic pallet drive arrangement 20 may also include a turntable 40 positioned in front of the robot 22 at a working position 41 of the robot as shown in FIG. 1. The turntable 40 provides for rotation and hence positioning of an anvil 42 at the working position 41 of the robot 22. Each point along the arc of the track 30 may be generally equidistant from the first axis of rotation 28 of the robot 22. It is only necessary that the robot arm 26 be capable of reaching the pallets 34 at and between the storage positions 39 and the working position 41.

A method of driving pallets 34 along a track 30 in a robotic roller hemming system 20 in order to index multiple anvil fixtures 42 supported by the pallets 34 is sequentially shown in FIGS. 1 through 6. Beginning at FIG. 1, the robot 22 is in the working position 41. A pallet 34 with a supported anvil 42 and the turntable 40 are located at the working position 41. The robot 22 is positioned such that the working arm 27 is within the range of the pallet 34 and anvil 42. When the pallet 34 and anvil 42 are in the working position 41, the turntable 40 holds the anvil 42 in position on a turntable top plate 44 to allow the robot 22 to hem a workpiece (not shown) on the anvil. To drive the pallets 34 along the track 30, the turntable 40 must first release its hold on the anvil 42. Next, the locking devices 36 are unlocked to allow for free movement of the pallets 34 along the track 30. As seen in FIG. 1, an open storage position 39 (i.e., a storage position that is not storing a pallet) is located counter-clockwise from the working position 41 along the track 30 and is open to receive a pallet 34.

Figure 2:
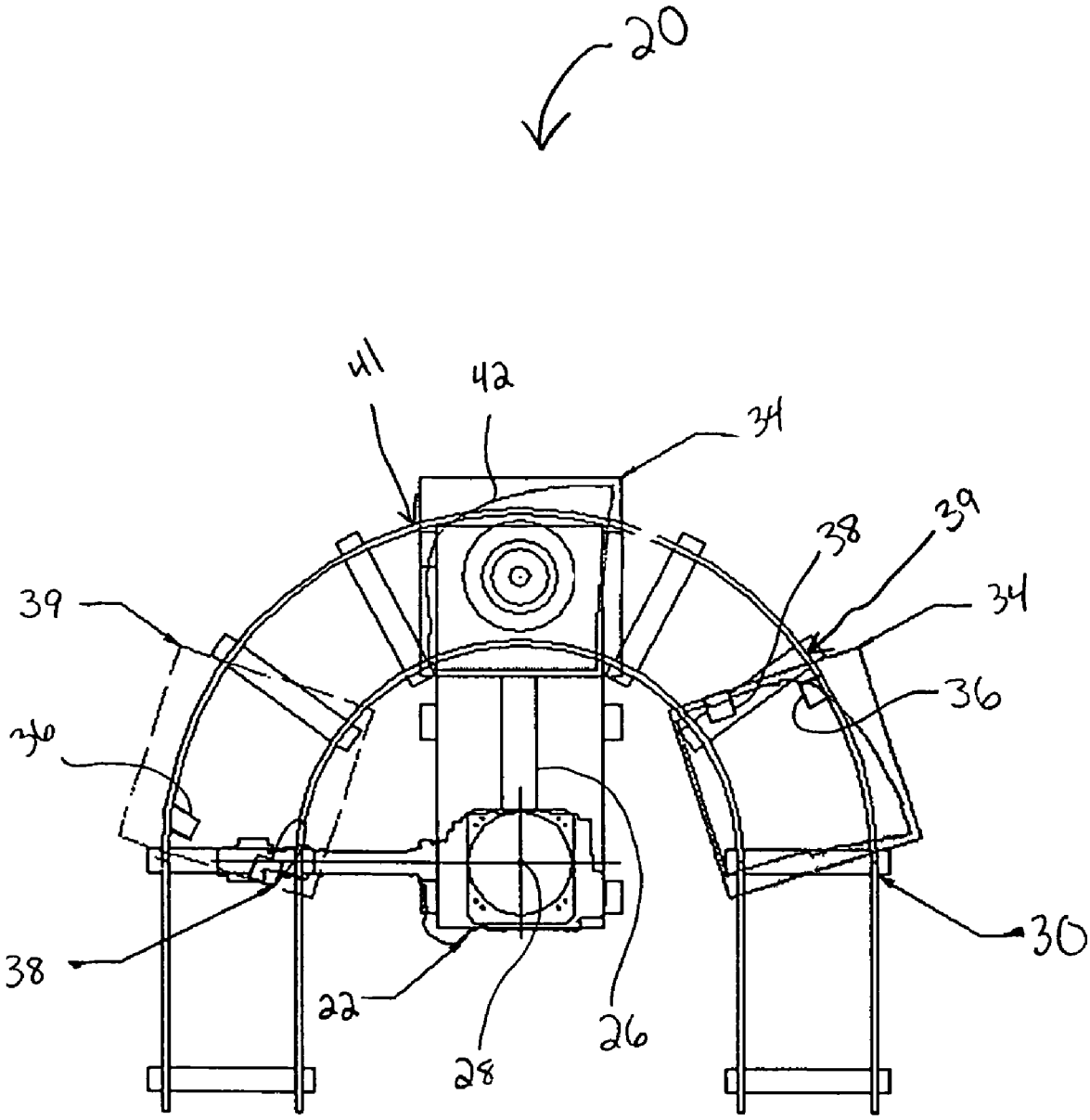
FIG. 2 is a schematic plan view of the robotic pallet drive arrangement of FIG. 1 illustrating a robot arm adapted for engagement with pallets engaged with a pallet.
Figure 3:
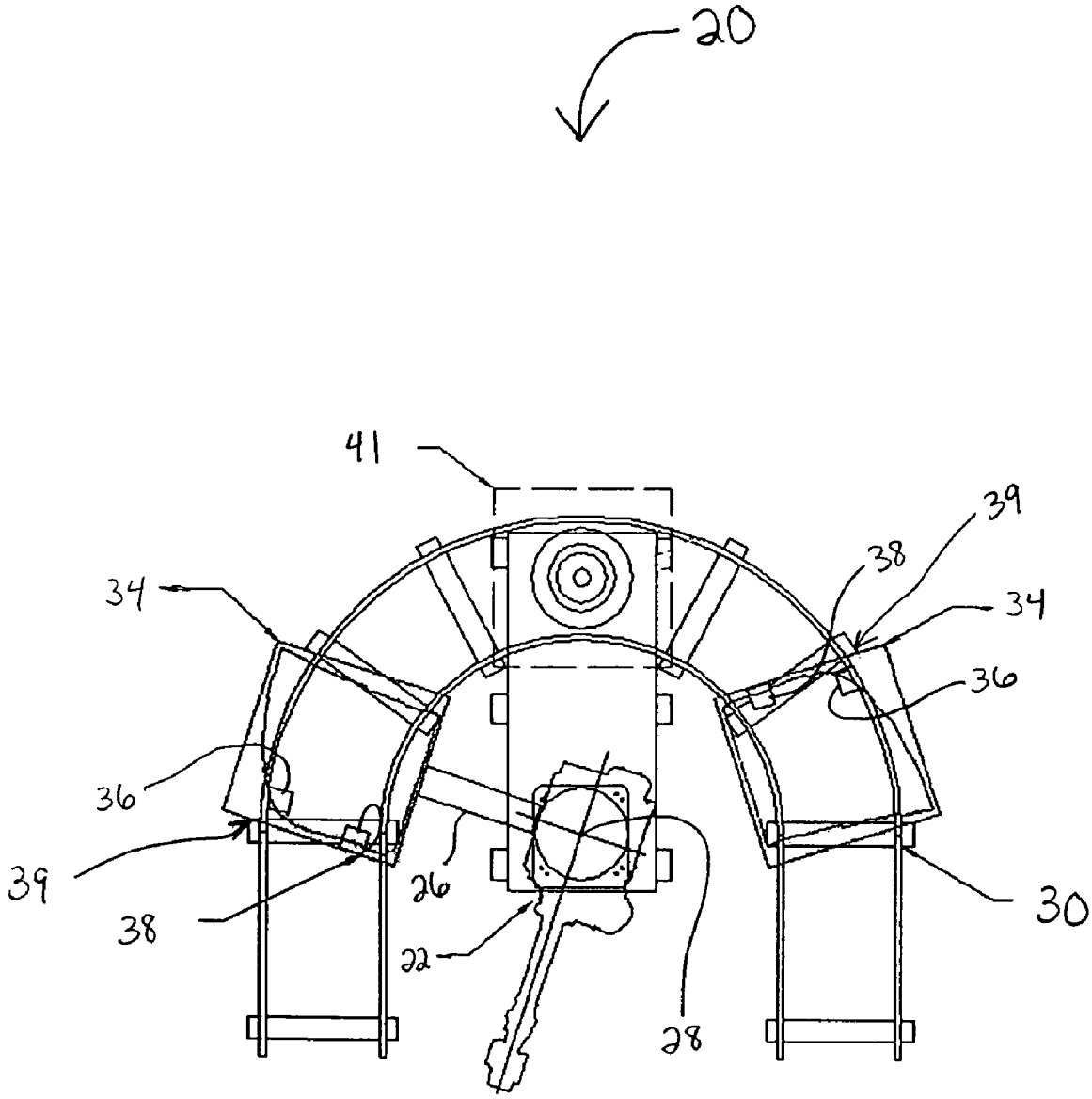
FIG. 3 is a schematic plan view of the robotic pallet drive arrangement of FIG. 1 illustrating the robot rotating about its first axis to move the engaged pallet to a storage position.
Figure 4:
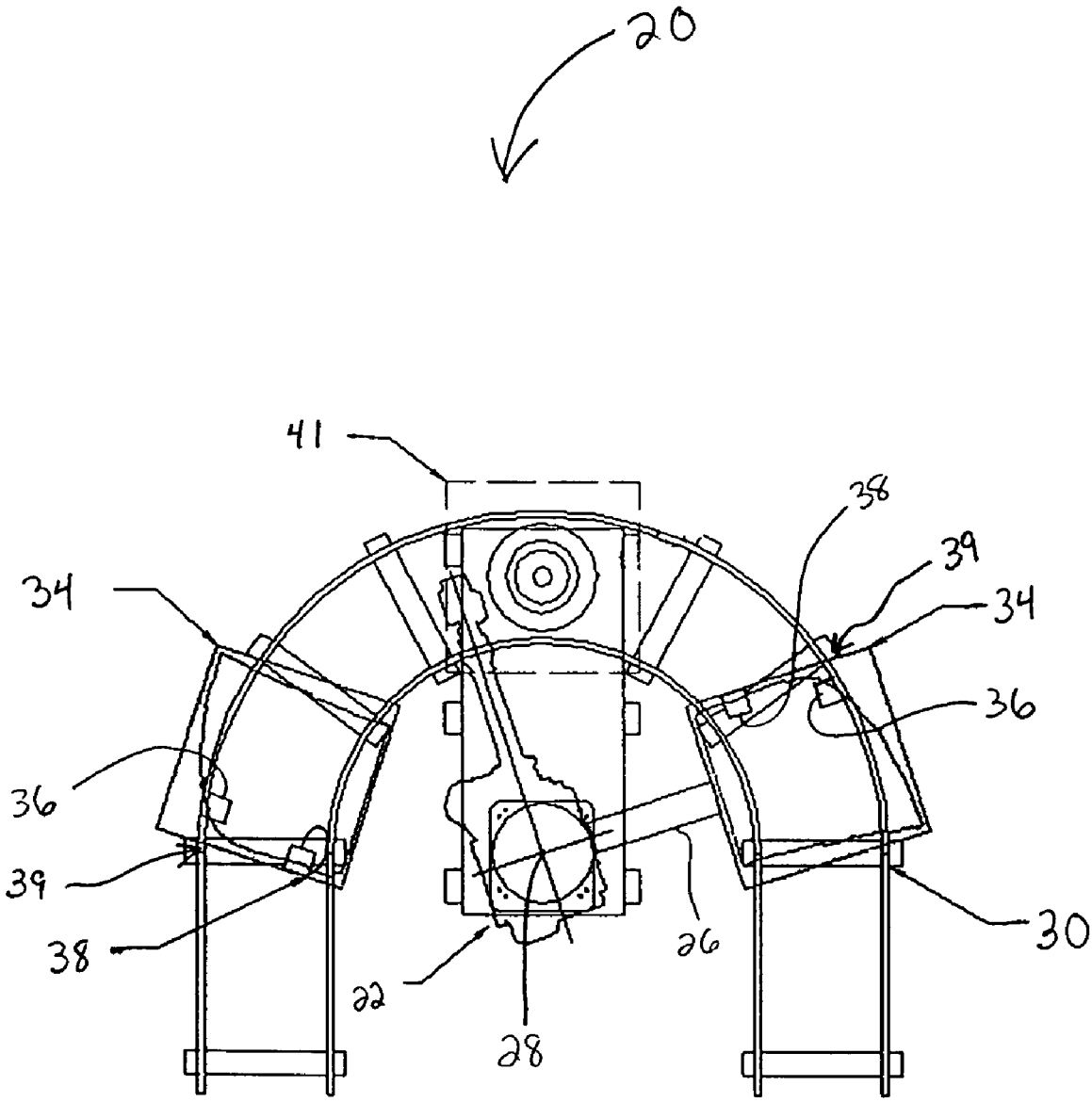
FIG. 4 is a schematic plan view of the robotic pallet drive arrangement of FIG. 1 illustrating the robot rotating about its first axis in order to be in position to engage another pallet.

To move the pallet 34 in the working position 41 to the open storage position 39, the robot 22 rotates counter-clockwise about its first axis 28 as shown in FIG. 2. The robot arm 26 extends to engage the pallet 34 that is in the working position 41. Next, as shown in FIG. 3, the robot 22 further rotates about its first axis 28 in the counter-clockwise direction. The robot arm 26 swings as the robot 22 rotates, and since the robot arm is engaged with the pallet 34, the pallet is driven along the track 30 from the working position 41 to the open storage position 39. The stop 38 stops the movement of the pallet 34 along the track 30 and aides in bringing the pallet to rest at the storage position 39. The robot arm 26 then releases the pallet 34.

The working position 41 is now an open position in the hemming system. In order for the robot 22 to be able to perform another hemming operation, it must move another pallet 34 to the working position 41. To accomplish this, as shown in FIG. 4 the robot 22 again rotates about its first axis 28 to align the robot arm 26 with another pallet 34. In this case, the other pallet 34 is located clockwise along the track 30 from the working position 41. The robot arm 26 extends to engage the pallet 34.

Figure 5:
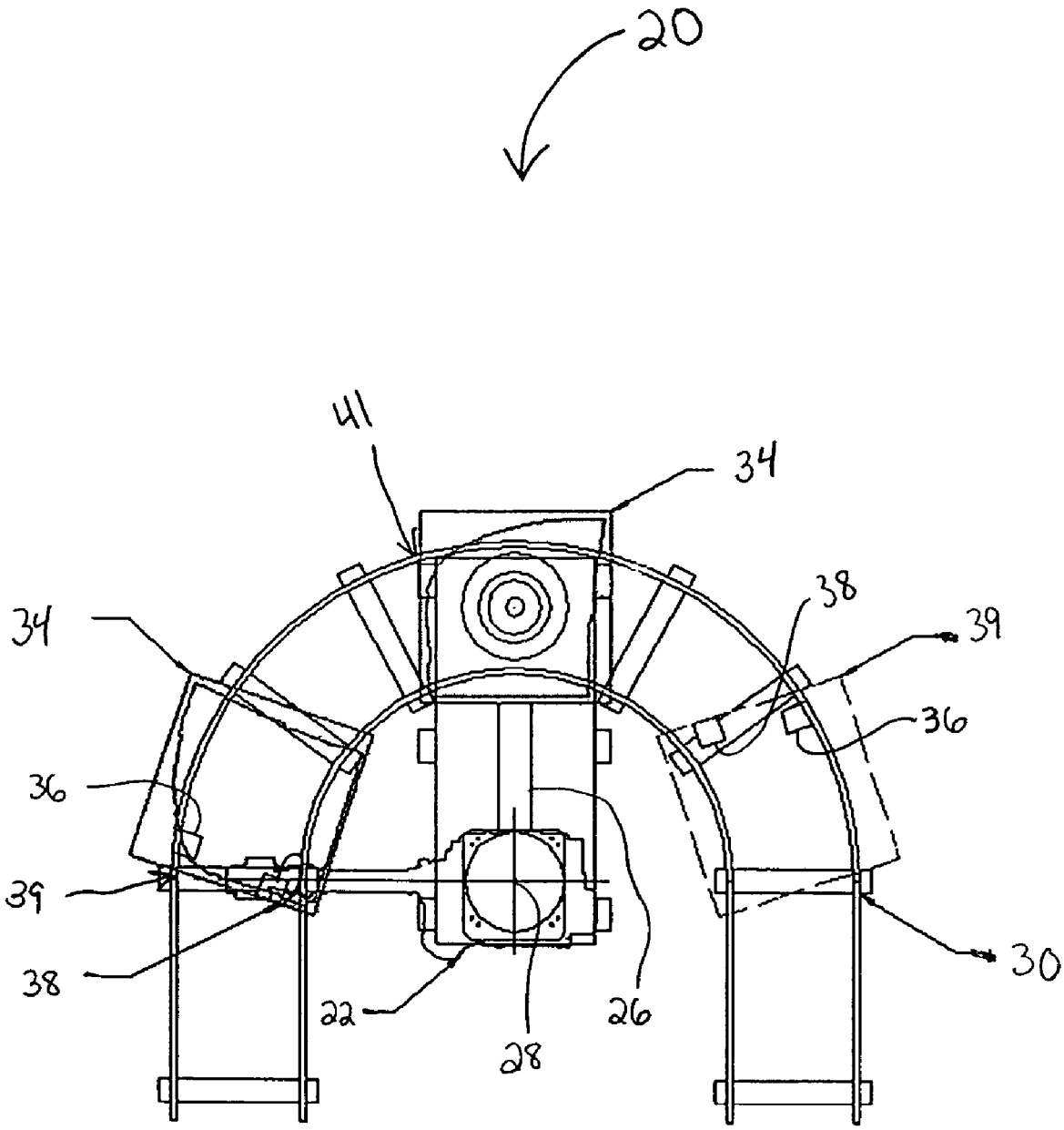
FIG. 5 is a schematic plan view of the robotic pallet drive arrangement of FIG. 1 illustrating the robot rotating about its first axis to move the engaged pallet to a working position.
Figure 6:
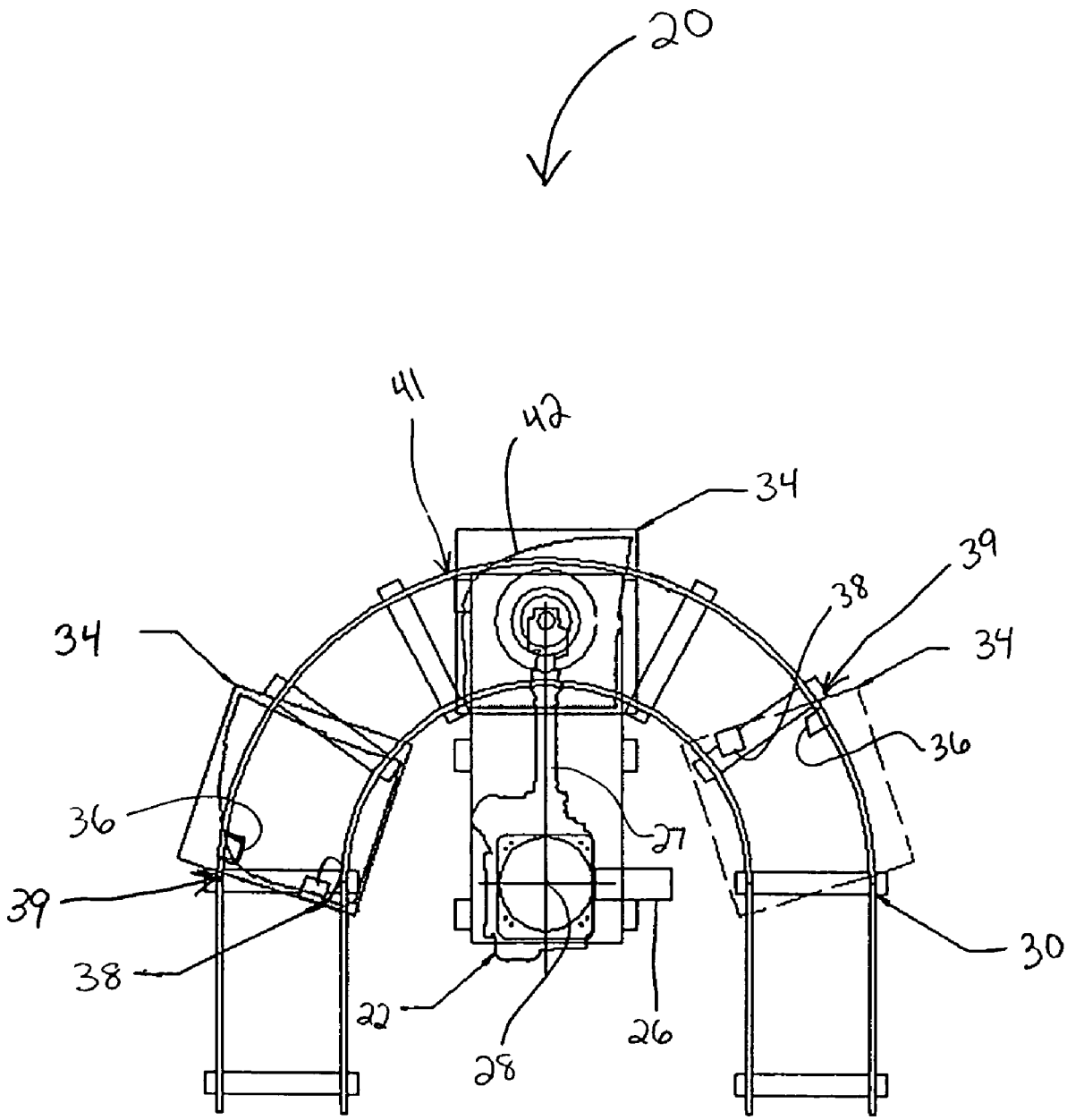
FIG. 6 is a schematic plan view of the robotic pallet drive arrangement of FIG. 1 illustrating the working arm of the robot returned to the working position.

Next, as shown in FIG. 5, the robot 22 rotates counter-clockwise about its first axis 28. Again, the robot arm 26 swings as the robot 22 rotates, and the engaged pallet 34 is thereby driven along the track 30 from the storage position 39 to the open working position 41. The storage position 39 that is located clockwise along the track 30 from the working position 41 now becomes an open storage position. The locking devices 36 are locked to hold the pallet 34 in the storage position 39. Finally, as shown in FIG. 6, the robot arm 26 releases from the pallet 34 and retracts. The robot 22 then rotates clockwise about its first axis 28 until the working arm 27 is positioned over the working position 41. The robot may perform another hemming operation using the anvil 42 now positioned in the working position 41.

Turning now to FIGS. 7 through 10, in a second embodiment of the present invention the robotic pallet drive arrangement 120 includes a robot 122 having a base 124 and a swingable, movable arm 126. The robot 122 has a first axis of rotation 128 extending through the base 124. A track 130 is spacedly disposed from the robot 122. The track 130 is generally arcuate in shape and may include guides 132 such as rails or similar. In this embodiment, the track 130 generally forms a circle, although it should be understood that the track may form any arcuate shape. A plurality of free-moving pallets 134 are supported by and movable on the track 130. The robot arm 126 is operably engagable with each of the pallets 134. In this embodiment, the arm 126 adapted for engagement with the pallets 34 is also the working arm of robot 122. In other words, the arm 126 serves two purposes; it is both the working arm of the robot 122 and the arm that engages the pallets 134. The track 130 may include at least one locking device 136 for releasably locking the pallets 134 to the track 130. Rotating the robot 122 about the first axis 128 while the robot arm 126 is engaged with one of the pallets 134 moves the engaged pallet 134 along the track 130.

Figure 7:
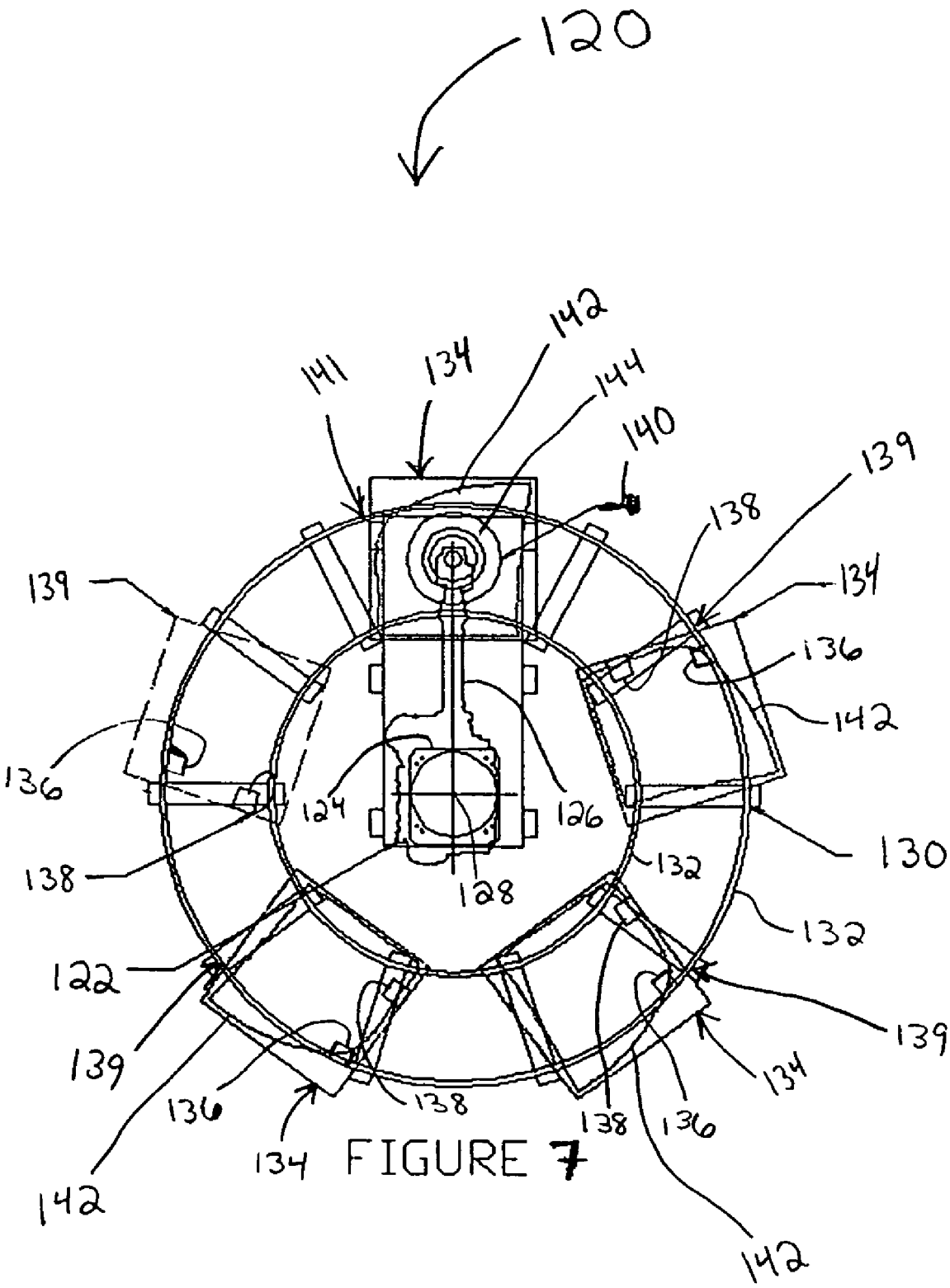
FIG. 7 is a schematic plan view of an alternative embodiment of the robotic pallet drive arrangement illustrating a robotic arm of a hemming robot in a working position.

Each point along the arc of the track 130 may be generally equidistant from the first axis of rotation 128 of the robot 122. The track 130 may have a plurality of stops 138 disposed along the track defining storage positions 139, and the locking devices 136 may be adapted to lock the pallets 134 at the storage positions. The stops 138 index the track 130. The robotic pallet drive arrangement 120 may also include a turntable 140 positioned in front of the robot 122 at a working position 141 of the robot as shown in FIG. 7. The turntable 140 provides for rotation and hence positioning of an anvil 142 at the working position 141 of the robot 122.

A method of driving pallets 134 along a track 130 in a robotic roller hemming system 120 according to the second embodiment of the present invention is sequentially shown in FIGS. 7 through 10. Beginning at FIG. 7, the robot 122 is in the working position 141. A pallet 134 with a supported anvil 142 and the turntable 140 are located at the working position 141. The robot 122 is positioned such that the arm 126 is within range of the pallet 134 and anvil 142. When the pallet 134 and anvil 142 are in the working position 141, the turntable 140 holds the anvil 142 in position on a turntable top plate 144 to allow the robot 122 to hem a workpiece (not shown) on the anvil. To drive the pallets 134 along the track 130, the turntable 140 must first release its hold on the anvil 142. Next, the locking devices 136 are unlocked to allow for free movement of the pallets 134 along the track 130. As seen in FIG. 7, an open storage position 139 is located counter-clockwise from the working position 141 along the track 130 and is open to receive a pallet 134.

Figure 8:
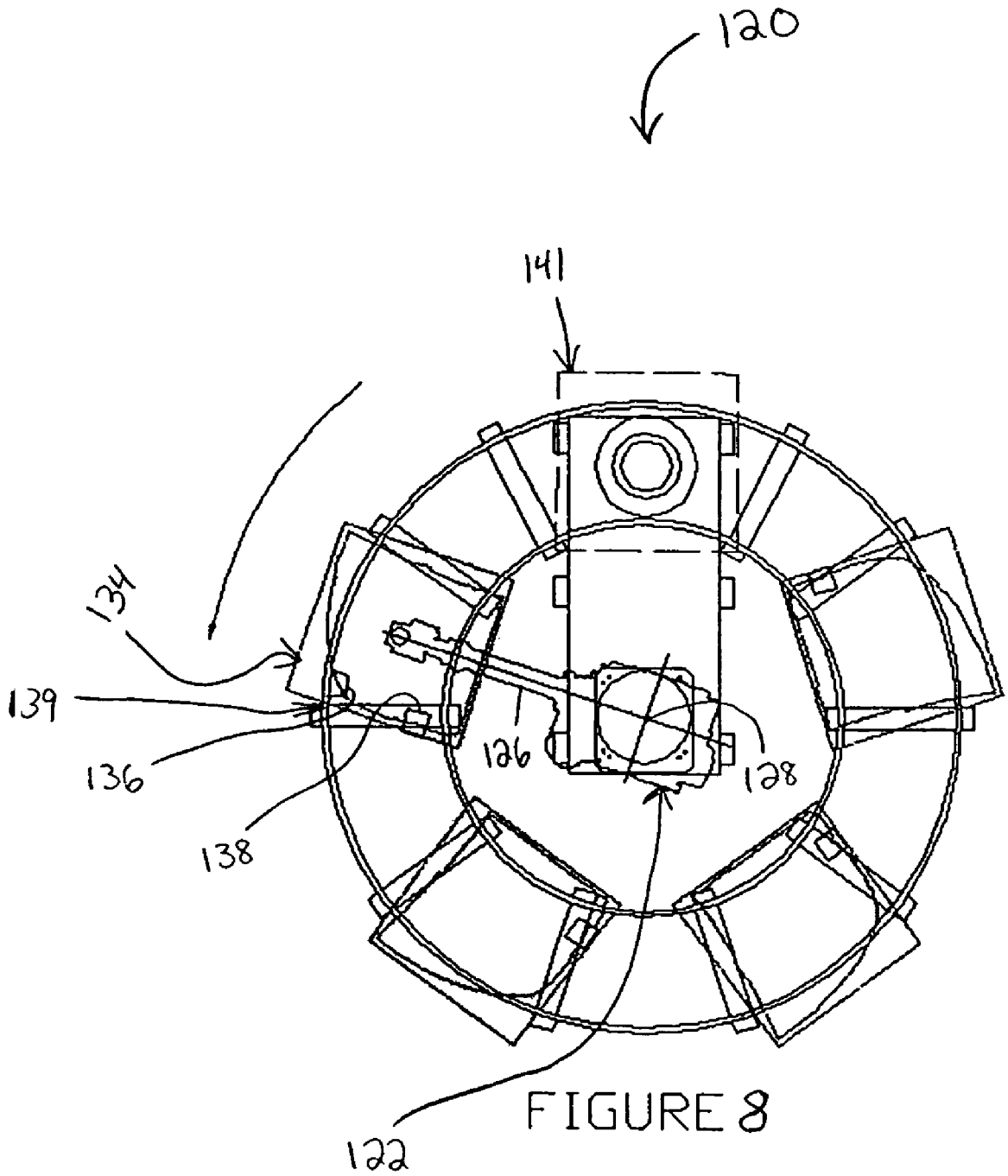
FIG. 8 is a schematic plan view of the embodiment of FIG. 7 illustrating the robot arm engaged with one of the pallets and the robot having rotated counter-clockwise about its first axis to move the engaged pallet to a storage position.
Figure 9:
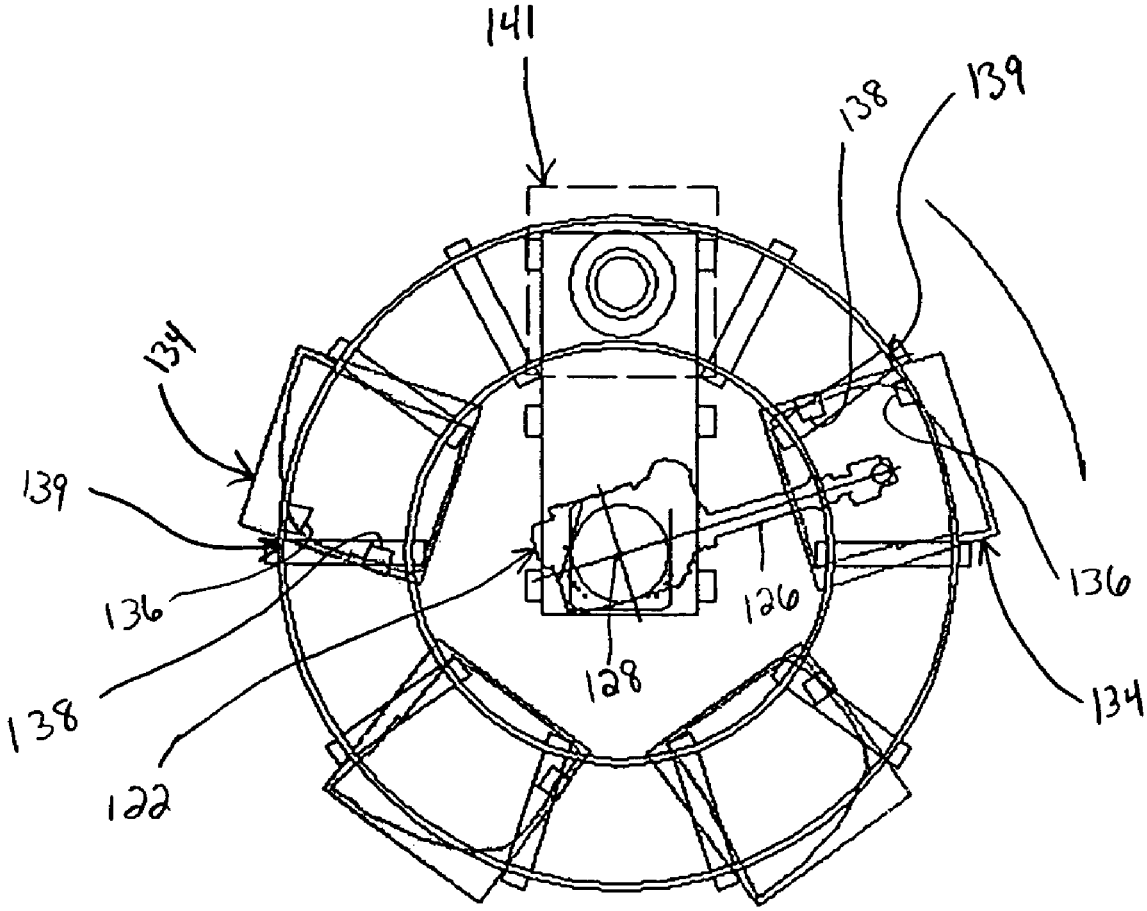
FIG. 9 is a schematic plan view of the embodiment of FIG. 7 illustrating the robot rotating clockwise about its first axis in order to be in position to engage another pallet.

To move the pallet 134 in the working position 141 to the open storage position 139, the robot arm 126 engages the pallet 134 that is in the working position. The robot 122 then rotates in the counter-clockwise direction about its first axis 128 as shown in FIG. 8. The robot arm 126 swings as the robot 122 rotates, and since the robot arm is engaged with the pallet 134, the pallet is driven along the track 130 from the working position 141 to the open storage position 139. The stop 138 stops the movement of the pallet 134 along the track 130 and aides in bringing the pallet to rest at the storage position 139. The robot arm 126 then releases the pallet 134.

The working position 141 is now an open position in the hemming system. In order for the robot 122 to be able to perform another hemming operation, it must move another pallet 134 to the working position 141. To accomplish this, as shown in FIG. 9 the robot 122 again rotates about its first axis 128 to align the robot arm 126 with another pallet 134. In this case, the other pallet 134 is located clockwise along the track 130 from the working position 141. The robot arm 126 engages the pallet 134.

Figure 10:
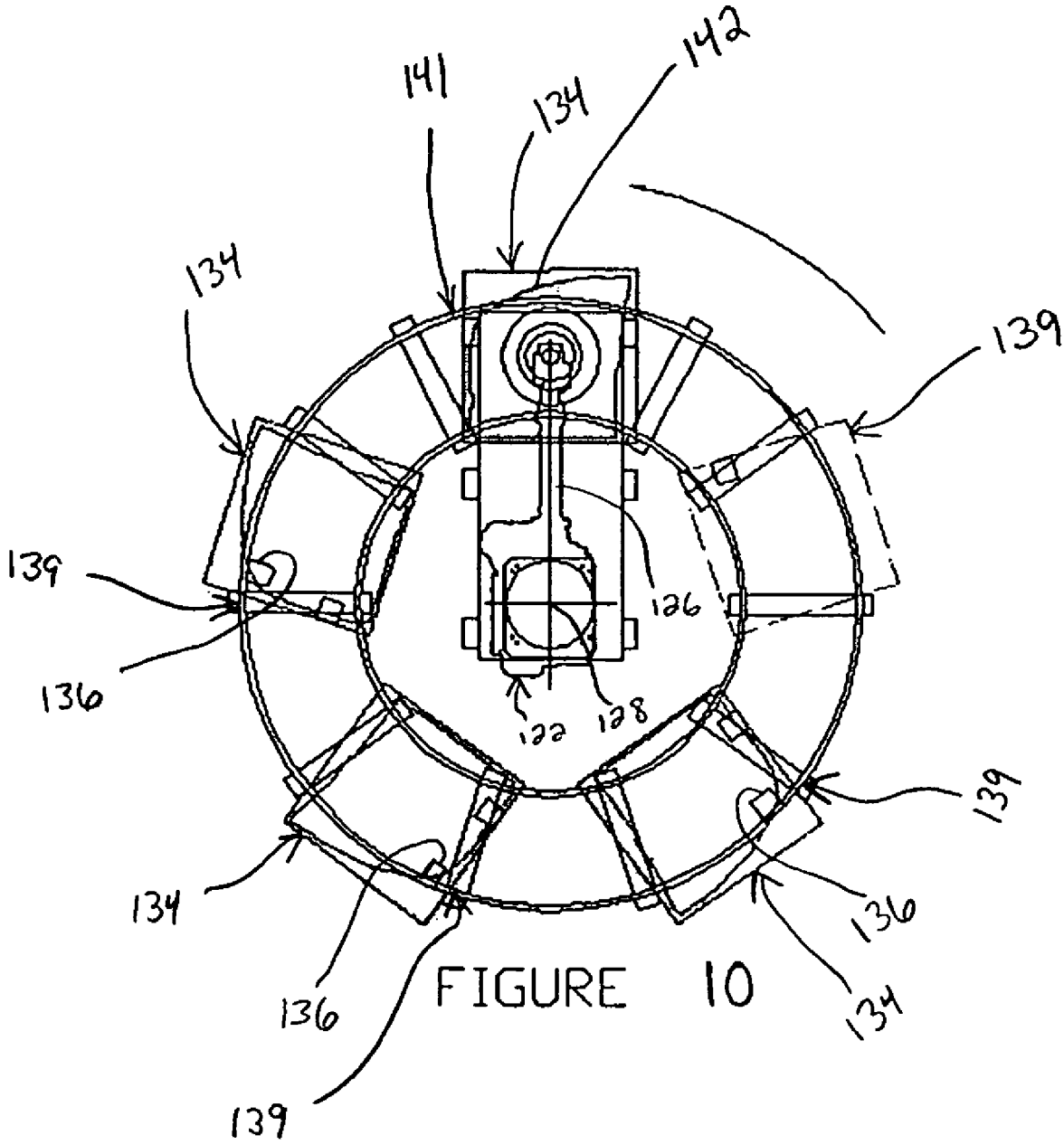
FIG. 10 is a schematic plan view of the embodiment of FIG. 7 illustrating the robotic arm engaged with a pallet and the robot having rotated counter-clockwise about its first axis to move the engaged pallet to a working position.

Next, as shown in FIG. 10, the robot 122 rotates counter-clockwise about its first axis 128. Again, the robot arm 126 swings as the robot 122 rotates, and the engaged pallet 134 is thereby driven along the track 130 from the storage position 139 to the open working position 141. The storage position 139 that is located clockwise along the track 130 from the working position 141 now becomes an open storage position. The locking devices 136 are locked to hold the pallets 134 in the storage positions 139. Finally, the robot arm 126 releases from the pallet 134. The arm 126 is positioned over the working position 141. The robot may perform another hemming operation using the anvil 142 now positioned in the working position 141.

In this embodiment, a pallet 134 may also be driven from one storage position 139 on the track 130 to an open storage position 139. For example, as illustrated in FIG. 10, an open storage position 139 is positioned clockwise along the track 130 from the working position 141. A pallet 134 is located at a storage position 139 that is clockwise along the track 130 from the open storage position. The robot 122 may drive the pallet 134 from its current position into the open storage position 139 by following the same steps as detailed above.

It should be understood that the distinct features of the first and second embodiments of the present invention may be interchanged. For example, a robotic pallet drive arrangement in accordance with the present invention may include a circular track and a robot having both a working arm and an auxiliary arm for engagement with the pallets. Alternatively, a robotic pallet drive arrangement may include a track shaped in an arc and a robot having a single arm that functions both as a working arm and an arm adapted for engagement with the pallets.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A robotic pallet drive arrangement in a robotic roller hemming system, said robotic pallet drive arrangement comprising:

a track including a guide;

a plurality of freely moveable pallets supported by and movable on said track, said pallets being engaged with said guide, and said track not including a drive for driving said pallets; and a robot having an arm adapted for engagement with said pallets;

whereby movement of said robot arm while said robot arm is engaged with one of said pallets moves the pallet along the track.

2. The robotic pallet drive arrangement of claim 1, wherein said robot includes a working arm in addition to said arm adapted for engagement with said pallets.

3. The robotic pallet drive arrangement of claim 1, wherein said arm adapted for engagement with said pallets is the working arm of said robot.

4. The robotic pallet drive arrangement of claim 1, wherein said track includes at least one locking device for releasably locking said pallets to said track.

5. The robotic pallet drive arrangement of claim 1, wherein said track is generally arcuate in shape.

6. The robotic pallet drive arrangement of claim 1, wherein said track is generally circular in shape.

7. A robotic pallet drive arrangement in a robotic roller hemming system, said robotic pallet drive arrangement comprising:

a robot including a base and a swingable, movable arm; said robot having a first axis of rotation extending through said base;

a track spacedly disposed from said robot, said track being generally arcuate in shape and including a guide, and said track being disposed around said base of said robot; and a plurality of free-moving pallets supported by and movable on said track, said pallets being engaged with said guide;

said robot arm being operably engagable with each of said pallets;

said track including at least one locking device for releasably locking said pallets to said track;

whereby rotating said robot about said first axis while said robot arm is engaged with one of said pallets moves the pallet along the track.

8. The robotic pallet drive arrangement of claim 7, wherein said robot includes a working arm in addition to said arm that is operably engagable with said pallets.

9. The robotic pallet drive arrangement of claim 7, wherein said arm that is operably engagable with said pallets is the working arm of said robot.

10. The robotic pallet drive arrangement of claim 7, wherein each point along the arc of said track is generally equidistant from the first axis of said robot.

11. The robotic pallet drive arrangement of claim 7, wherein said track has a plurality of stops disposed along the track defining storage positions, and said locking device is adapted to lock said pallets at said storage positions.

12. The robotic pallet drive arrangement of claim 7, wherein said track is generally circular in shape.

13. The robotic pallet drive arrangement of claim 7, further including a turntable positioned in front of said robot at a working position along said track.

* * * * *